US006322191B1

(12) United States Patent
Seshimo et al.

(10) Patent No.: US 6,322,191 B1
(45) Date of Patent: Nov. 27, 2001

(54) METHOD OF ADJUSTING PRINTING POSITION, PRINTING APPARATUS USING THE SAME, AND RECORDING MEDIUM HAVING PROGRAM FOR THE SAME

(75) Inventors: Tatsuya Seshimo; Hitoshi Igarashi; Yukihiro Uchiyama; Kenjiro Murakami, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/065,608

(22) Filed: Apr. 24, 1998

(30) Foreign Application Priority Data

Apr. 24, 1997 (JP) ..... 9-121689
Apr. 24, 1997 (JP) ..... 9-121698
Mar. 26, 1998 (JP) ..... 10-079121
Mar. 26, 1998 (JP) ..... 10-079122

(51) Int. Cl.[7] ..... B41J 29/39
(52) U.S. Cl. ..... 347/19
(58) Field of Search ..... 347/19, 37, 43; 702/120; 382/184

(56) References Cited

U.S. PATENT DOCUMENTS 4,878,063 10/1989 Katerberg ..... 346/1.1
5,534,895 * 7/1996 Lindenfelser et al. ..... 347/19
5,610,639 * 3/1997 Takada et al. ..... 347/19
5,799,314 * 8/1998 Provino et al. ..... 707/104
5,880,749 * 3/1999 Kikkawa et al. ..... 347/9
6,084,606 * 7/2000 Moriyama ..... 347/19
6,104,986 * 8/2000 Arevalo ..... 702/120
6,109,722 * 8/2000 Underwood et al. ..... 347/19

FOREIGN PATENT DOCUMENTS 0 589 718 3/1994 (EP) ..... B41J/2/01
0 540 244 5/1993 (EP) ..... B41J/25/304
0 735 504 10/1996 (EP) ..... G06K/15/02

* cited by examiner

*Primary Examiner*—John Barlow
*Assistant Examiner*—Julian D. Huffman
(74) *Attorney, Agent, or Firm*—Sughrue, Mion, Zinn, Macpeak & Seas, PLLC

(57) ABSTRACT

A printing apparatus arranged to perform printing while a monochrome printing head and a color printing head are moved in a direction in which the two heads are moved, the printing apparatus being arranged to print a plurality of patterns in which the relative quantity of deviation of printing timings of the two heads is changed in a stepped manner to cause a user to select a pattern having the smallest quantity of deviation among the plural patterns. Then, the selected pattern is used as a central value when a plurality of patterns in which the relative quantity of deviation of the printing timings of the two heads is changed in a stepped manner are furthermore printed to cause the user to select a pattern having a smallest quantity of deviation from the plural patterns. The above-mentioned process is repeated as necessary. As a result, the operation which is performed by the user to adjust the printing position can simply and easily be performed. Control is performed in such a manner as to change color to be printed by the color printing head whenever an adjustment mode in which the relative quantity of deviation of the printing timing is adjusted is started.

19 Claims, 4 Drawing Sheets

FIRST PRINTING

FIG. 2 (II)

SECOND PRINTING

FIG. 2 (III)

THIRD PRINTING

FIG. 2 (IV)

FOURTH PRINTING

FIRST PRINTING STEP = 0.6

FIG. 3 (II)

SECOND PRINTING STEP = 0.6

FIG. 3 (III)

THIRD PRINTING STEP = 0.3

FIG. 3 (IV)

FOURTH PRINTING STEP = 0.15

METHOD OF ADJUSTING PRINTING POSITION, PRINTING APPARATUS USING THE SAME, AND RECORDING MEDIUM HAVING PROGRAM FOR THE SAME

BACKGROUND OF THE INVENTION (1) Field of the Invention

The present invention relates to a method of adjusting a printing position which is adaptable to a printing apparatus having, for example, a monochrome printing head and a color printing head and arranged to perform a printing operation in such a manner that the both printing heads are moved in the direction in which the both printing heads are disposed, a printing apparatus using the adjustment method and a computer readable medium on which a control program of computer readable instructions for performing the adjustment method is stored.

(2) Description of the Related Art

Due to the advent of powerful personal computers, graphics-intensive processes can now be relatively easily performed. Accordingly, there has arisen a requirement for a printing apparatus capable of producing high-quality color graphical output on hard copy. To satisfy the above-mentioned requirement, printing apparatuses of a type having an ink jet printing head have been provided. The ink jet printing apparatuses of the foregoing type are able to perform a printing operation with a relatively low noise sound level. Moreover, the ink jet printing apparatuses are able to form a small dot at a high density. Therefore, the ink jet printing apparatuses of the foregoing type have been employed to perform a multiplicity of printing operations including color printing.

The ink jet printing apparatus of the foregoing type incorporates an ink jet printing head arranged to be supplied with ink from an ink accommodating means and a paper feeding means for relatively moving recording paper with respect to the ink jet printing head. In response to a print command signal, an ink droplet is discharged to form a dot so that a printing operation is performed.

The printing apparatus of the foregoing type has a common head holder (carriage) on which a monochrome printing head, capable of discharging black ink, and a color printing head, capable of discharging a plurality of colored inks (e.g., yellow, cyan, and magenta ink), are mounted. Thus, the printing apparatus of the foregoing type is able to perform a full color printing operation, by changing the discharge ratio of ink in the foregoing colors, and also is able to print text using black ink.

The carriage on which the monochrome printing head and the color printing head are mounted is pulled by a timing belt which is rotated by a motor for operating the carriage so as to perform a reciprocating motion in the direction of the printing lines. That is, both of the monochrome printing head and the color printing head are moved in the direction in which the two heads align so that the printing operation is performed.

In the above-mentioned printing apparatus, the monochrome printing head is spaced from the color printing head. In other words, they are disposed apart from each other. Because the two printing heads are spaced from each other, it is impossible to print in the same location from both heads at the exact same time. Therefore, when ink is to be discharged from the two printing heads in the same location, a precise alignment between the two heads is necessary. In particular, the monochrome printhead will print in a particular location at a timing different from when the color printhead prints at that same location. In other words, printing cannot be performed at the same position of paper at the same timing. Therefore, ink discharge is performed in such a manner that timings of print signals arranged to be supplied to the two heads are shifted from each other. Thus, the printing position (the ink arrival position) of the monochrome printing head and the printing position of the color printing head are adjusted to coincide with each other in the direction in which the heads are moved.

However, variations of the two assembled heads, change in the environmental temperature and vibrations cause the relative positions between the two heads to be deviated. As a result, the printing position of the monochrome printing head and that of the color printing head are deviated from each other in the direction in which the two heads are moved. As a result, the quality of the printed image deteriorates.

To modify deviation in the printing position, a printing apparatus having a function capable of adjusting the printing position has been provided. FIG. 4 shows a method of adjusting the printing position employed by a printing apparatus having the conventional function of adjusting the printing position. The printing-position adjustment method is arranged in such a manner that timing data for delaying timing stored in a control unit of the printing apparatus is gradually changed. Thus, a plurality of stepped-deviation patterns (in this case, twelve patterns (A) to (L)) in which the quantity of relative deviation in the printing timing between the monochrome printing head and the color printing head is changed in a stepped manner are simultaneously printed on one page of A4-size paper.

In the pattern shown in FIG. 4, solid lines indicate results of printing operations performed by the monochrome printing head and dashed lines indicate results of printing operations performed by the color printing head. When the ink jet printing apparatus prints the foregoing patterns, upper half nozzles of nozzle lines on the ink discharge surface of the printing head composed of a plurality of nozzles of the monochrome head disposed in a direction perpendicular to the direction (the main scanning direction) in which the heads are disposed are used. On the other hand, lower half nozzles of the color head are used by the color head.

As can be understood from the patterns (A) to (L), the printing positions (indicated by the dashed lines) of the color head with respect to the printing positions (indicated by the solid lines) of the monochrome head are, in a stepped manner, deviated in a rightward direction from the pattern (A) to the pattern (L). That is to say, each of the patterns is printed with a different respective print deviation timing value. This timing value varies in a stepped manner from one to another of the printed patterns. The steps are all the same, and the difference between one pattern and the next may be understood to be a step size.

A user subjects the patterns (A) to (L) to comparisons to select a pattern having the smallest quantity of deviation. Then, a symbol corresponding to the selected pattern is input to the printing apparatus. Since the pattern (I) has the smallest quantity of deviation in this case, symbol (I) is input to the printing apparatus.

When the symbol corresponding to the pattern is input to the printing apparatus, data corresponding to the symbol (which is I in this case), is written on a control unit of the printing apparatus (hereinafter also called as a "printer") so that adjustment of the printing position is completed.

When the printing position is adjusted, color of ink for use to print the pattern by the color printing head is limited to a specific color (for example, cyan).

The above-mentioned conventional method of adjusting the printing position of the printing apparatus is arranged in such a manner that a plurality of patterns are printed one time and an optimum pattern among the plural patterns is selected by a user. Therefore, if the range of the quantity of deviation which can be adjusted is enlarged or if the adjustment accuracy is improved (that is, if the quantity of change (the quantity of deviation) between patterns is reduced), there arises a problem in that an operation required for the user to perform selection becomes too complicated.

The foregoing fact will specifically be described. In general, the quantity of change which can be determined visually by a human being is limited to 0.01 mm. If the quantity of change between patterns in the stepped manner is too large (i.e., if the step size is too large), a required adjustment cannot be performed. If the quantity of change is determined to be 0.1 mm and the number of patterns which can be printed on A4-size paper is assumed to be 15, the quantity of deviation which can be adjusted by the conventional printing-position adjustment method for the printing apparatus is 1.4 mm (the value is not 15 mm because of existence of a central value).

However, the deviation of the printing position between the two heads occurring due to the foregoing change in the environmental temperature or the like is sometimes 1.4 mm or greater. When the range in which the printing position can be adjusted is enlarged to, for example, about 2.9 mm to overcome the above-mentioned problem, the conventional method of adjusting the printing position is required to simultaneously print thirty patterns.

Since the above-mentioned patterns cannot be printed on one A4-size paper, the patterns are printed across a page boundary. Therefore, the user must subject the thirty patterns printed across the page boundary to comparisons to select one optimum pattern. Therefore, there arises a problem in that a complicated adjustment operation must be performed.

Today, printing apparatuses are now able to form images with higher resolution than ever before. With such high-resolution printing, even a slight deviation in the printing position of the monochrome printing head vis-a-vis the printing position of the color printing head produces a very noticeable decrease in image printing quality. To put it another way, in high-quality printing, there is an excessive influence on print quality when there is even a slight deviation in the printing position between the monochrome printing head and the color printing head. Therefore, the process of adjusting the alignment of the two printheads with each other must be more precise than ever. That is, improvement in the adjustment accuracy (reduction of the quantity of change (the quantity of deviation) between patterns in the stepped manner) has been required.

If the quantity of change is set to be 0.05 mm and the quantity of deviation which can be adjusted is made to be 1.4 mm (which is not 2.9 mm) to satisfy the above-mentioned requirement, the conventional printing-position adjustment method is required to print thirty patterns. Therefore, the thirty patterns are printed across the page boundary of A4-size paper.

Similarly, the user must subject the thirty patterns printed across the page boundary to comparisons to select one optimum pattern. Therefore, there arises the same problem in that a complicated adjustment operation must be performed. Also in this case, a multiplicity of patterns of small quantities of change must simultaneously be subjected to comparisons. Providing the user with such a great number of different printed patterns, each varying from the other by such very small quantities of change, makes the adjustment operation much too complicated complicated for average users to perform.

As described above, the conventional printing-position adjustment method is arranged in such a manner that a plurality of patterns are printed one time to cause a user to select one optimum pattern. Therefore, if the range of the quantity of deviation which can be adjusted is enlarged or if the adjustment accuracy is improved, the user cannot smoothly perform the selecting operation.

The conventional printing-position adjustment method has the structure that the color for use to print the patterns by the color printing head is limited to a specific color. Therefore, only the ink of the specific color is consumed in a larger quantity as compared with ink of the other colors. If cyan ink is used to print the patterns by the color ink jet printing head, only the cyan ink is consumed in a larger quantity as compared with ink of the other colors.

In general, an ink pack in which yellow, cyan and magenta ink is enclosed is mounted on a cartridge of color ink. If ink of a certain color is somewhat consumed, the cartridge must be changed.

That is to say, an ink pack that has three colors such as yellow, cyan, and magenta, must have some of each color ink to print. If the ink of one specific color is deemed to be at a level that is too low, it is necessary to change the entire cartridge even though there is plenty of the other colors of ink remaining in the cartridge. Discarding a cartridge that is only low in one color of ink is uneconomical and wasteful, and causes a problem for users.

SUMMARY OF THE INVENTION

In view of the foregoing, a first object of the present invention is to provide a printing-position adjustment method capable of facilitating an operation for adjusting the printing position which is performed by a user, enlarging a range of a quantity of deviation of printing which can be adjusted and improving an adjustment accuracy, a printing apparatus adapted to the adjustment method and a computer readable medium on which a program for controlling adjustment of the printing position is stored.

A second object of the present invention is to provide a printing-position adjustment method capable of preventing a phenomenon that only ink in a specific color is consumed in a larger quantity as compared with ink in other colors, a printing apparatus adapted to the adjustment method and a computer readable medium on which a program for controlling adjustment of the printing position is stored.

Other objects, features and advantages of the invention will be evident from the following detailed description.

According to one preferred aspect of the present invention, there is provided a printing-position adjustment method adaptable to a printing apparatus having a first printing head and a second printing head and arranged to perform a printing operation while the two heads are moved in a direction in which the two heads align, the printing-position adjustment method comprising the steps of: printing a plurality of patterns in which a relative quantity of deviation of printing timings of the two heads is changed in a stepped manner to cause a user to select a pattern having a smallest quantity of deviation from the plural patterns; and making the selected pattern to be a central value, printing a plurality of patterns in which a relative quantity of deviation of printing timings of the two heads is changed in a stepped manner to cause the user to select a pattern having a smallest quantity of deviation from the plural patterns and repeating the steps as necessary so that the printing timings of the two heads are adjusted.

In this case, it is preferable that a method is employed in which the relative quantity of deviation which is changed in the plural patterns is made to be smaller than the relative quantity of deviation changed in the pattern printed previously.

In this case, it is preferable that a method is employed in which when a pattern of the plural patterns except for end patterns is selected by the user, the relative quantity of deviation is reduced.

According to another aspect of the present invention, there is provided a printing-position adjustment method which is adaptable to a printing apparatus having a monochrome printing head and a color printing head and arranged to perform a printing operation while the two heads are moved in a direction in which the two heads align and in which a plurality of patterns in which a relative quantity of deviation of printing timings of the two heads is changed in a stepped manner are printed to cause a user to select a pattern having a smallest quantity of deviation from the plural patterns so that the printing timings of the two heads are adjusted, the printing-position adjustment method comprising the step of: changing color to be printed by the color printing head whenever an adjustment mode is started in which the relative quantity of deviation of the printing timings is adjusted.

According to another aspect of the present invention, there is provided a printing-position adjustment method which is adaptable to a printing apparatus having a monochrome printing head and a color printing head and arranged to perform a printing operation while the two heads are moved in a direction in which the two heads align and in which a plurality of patterns in which a relative quantity of deviation of printing timings of the two heads is changed in a stepped manner are printed, a user is caused to select a pattern having a smallest quantity of deviation from the plural patterns, the selected pattern is made to be a central value when a plurality of patterns in which a relative quantity of deviation of printing timings of the two heads is changed in a stepped manner are printed, the user is caused to select a pattern having a smallest quantity of deviation from the plural patterns and the steps are repeated as necessary so that the printing timings of the two heads are adjusted, the printing-position adjustment method comprising the step of: changing color to be printed by the color printing head whenever the plurality of patterns are printed.

According to another aspect of the present invention, there is provided a printing apparatus having a first printing head and a second printing head and arranged in such a manner as to perform printing while the two heads are moved in a direction in which the two heads align, the printing apparatus comprising: printing control means for printing a plurality of patterns in which the relative quantity of deviation of printing timings of the two heads is changed in a stepped manner; pattern input means for inputting a pattern having a small quantity of deviation of printing of the two heads among the plurality of the printed patterns; adjustment-pattern control means for performing administration in such a manner as to repeat at least one time the operation that the pattern supplied by the pattern input means and having the small quantity of deviation is made to be a central value, a command is issued to the printing control means to print the plural patterns in which the relative quantity of deviation of the printing timings of the two heads is changed in the stepped manner and the pattern having the small quantity of deviation of printing performed by the two heads among the plurality of the printed patterns is input to the pattern input means; and means for storing a quantity of deviation of adjustment timing in such a manner as to store data of a quantity of deviation of printing timings in accordance with the pattern supplied by the pattern input means and having the small quantity of deviation.

It is preferable that the adjustment-pattern control means performs control in such a manner that a relative quantity of deviation which is changed in a pattern which is printed next is made to be smaller than a relative quantity of deviation changed in the plural patterns printed previously. In this case, it is preferable that the adjustment-pattern control means performs control in such a manner as to reduce the relative quantity of deviation which is changed in a pattern to be printed next when a pattern of the plural patterns printed previously except for end patterns has been supplied by the pattern input means.

It is preferable that the adjustment-pattern control means is structured in such a manner as to change color to be printed by the printing head whenever an adjustment mode is started in which the relative quantity of deviation of the printing timing is adjusted or whenever the plural patterns are printed.

It is preferable that a host computer is further provided which for receives a control program for adjusting the printing position which is performed by the printing apparatus. It is preferable that the host computer is structured to receive the control program through a communication network or receive the control program from a computer readable medium which can be read through a reading unit.

According to one aspect of the present invention, there is provided a computer readable medium in which a control program is, in a read-enabled manner, stored which adjusts a printing position of a printing apparatus having a first printing head and a second printing head and arranged to perform printing while the two heads are moved in a direction in which the two heads align, the computer readable medium comprising a control program for causing the printing apparatus to perform the steps of: causing printing control means to print a plurality of patterns in which the relative quantity of deviation of printing timings of the two heads is changed in a stepped manner; causing pattern input means to input a pattern having a small quantity of deviation of printing of the two heads among the plurality of the printed patterns; causing adjustment-pattern control means to perform administration in such a manner as to repeat at least one time the operation that the pattern supplied by the pattern input means and having the small quantity of deviation is made to be a central value, a command is issued to the printing control means to print the plural patterns in which the relative quantity of deviation of the printing timings of the two heads is changed in the stepped manner and the pattern having the small quantity of deviation of printing performed by the two heads among the plurality of the printed patterns is input to the pattern input means; and causing means for storing a quantity of deviation of adjustment timing to store data of a quantity of deviation of printing timings in accordance with the pattern supplied by the pattern input means and having the small quantity of deviation.

In this case, it is preferable that a program is, in a read-enabled manner, stored which causes the adjustment-pattern control means to perform control in such a manner as to change color to be printed by the recording head whenever the adjustment mode is started in which the relative quantity of deviation of the printing timing is adjusted or whenever the plural patterns are printed As one of preferred aspects of the computer readable medium on which the control program is stored and which can be read, a CD-ROM may be employed.

When the printing-position adjustment method, the printing apparatus adapted to the adjustment method or the program for controlling the adjustment of the printing position stored in the recording medium is performed, the plural patterns in which the relative quantity of deviation of the printing timings of the monochrome printing head serving as the first printing head and the color printing head serving as the second printing head is changed in a stepped manner are printed by the two heads. A pattern having a smallest quantity of deviation is, by a user, selected from the plural patterns.

Since color to be printed by the color printing head is changed whenever the mode for adjusting the printing position is started, a problem that only ink in a specific color is consumed in a larger quantity as compared with ink in other colors can be prevented.

The plural patterns in which the relative quantity of deviation of the printing timings of the monochrome printing head and the color printing head is changed in a stepped manner are printed by the two heads. A pattern having a smallest quantity of deviation is, by a user, selected from the plural patterns.

The selected pattern is used as a central value when a plurality of patterns, in which the relative quantity of deviation of the printing timings of the two heads is changed in a stepped manner, are furthermore printed. A pattern having a smallest quantity of deviation is, by the user, selected from the plural patterns. Then, the foregoing process, that is, a process in which the selected pattern is used as a central value, a plurality of patterns in which the relative quantity of deviation of printing timings of the two heads is changed in a stepped manner are printed and then a pattern having a smallest quantity of deviation is, by the user, selected from the plural patterns, is repeated as necessary. Thus, printing timings of the two heads are adjusted.

Note that the expression as necessary means continuation of a process until a pattern having a smallest quantity of deviation is obtained in an accuracy range which is attempted to be adjusted.

When the above-mentioned printing adjusting mechanism is employed, the patterns to be printed simultaneously are printed at least in two times. Moreover, the plural patterns which are printed simultaneously in the second and following operations are in the form in which the pattern selected previously is the central value. Therefore, the quantity of deviation of the plural patterns which are printed simultaneously is sequentially reduced as the number of operations increases. Namely, the quantity of deviation is sequentially converged.

Since the patterns to be printed simultaneously are printed at least in two times of operations, the number of patterns which must be subjected to comparisons by the user can be reduced to at least half the number required for the conventional printing-position adjustment method. As a result, the selection operation of the user can be facilitated.

Since the quantity of deviation of the plural patterns which are printed simultaneously is sequentially converged as the number of operations increases, the operation for adjusting the printing position can efficiently be performed. Therefore, the adjusting operation which is performed by the user can be facilitated. Moreover, the range of the quantity of deviation which can be adjusted can be enlarged and the adjustment accuracy can be improved.

Moreover, a function of adjusting the printing position is employed in which the relative quantity of deviation which is changed in the plural patterns is made to be smaller than the relative quantity of deviation changed in the pattern printed previously. Another function is employed with which the relative quantity of deviation is reduced when a pattern of the plural patterns except for the end patterns is selected by a user. Therefore, the adjusting operation can furthermore efficiently be performed. Moreover, a satisfactory adjustment accuracy can efficiently be obtained.

Also in this case, color to be printed by the color printing head is changed whenever the plural patterns are printed. Therefore, the problem that only ink in a specific color is consumed in a larger quantity as compared with ink in other colors can be prevented. Therefore, an uneconomical problem that the ink cartridge must be changed through ink in the other colors remains satisfactorily can be prevented.

When a user purchases a computer readable medium, for example, a CD-ROM, on which the control program for performing the operation for adjusting the printing position is stored, the user is able to easily perform the operation for adjusting the printing position. Since a similar control program can be obtained through a communication network, a function for adjusting the printing position maximally using the function of a network printer can be realized.

DETAILED DESCRIPTION OF THE PREFERRED EMBODIMENTS

Figure 1:
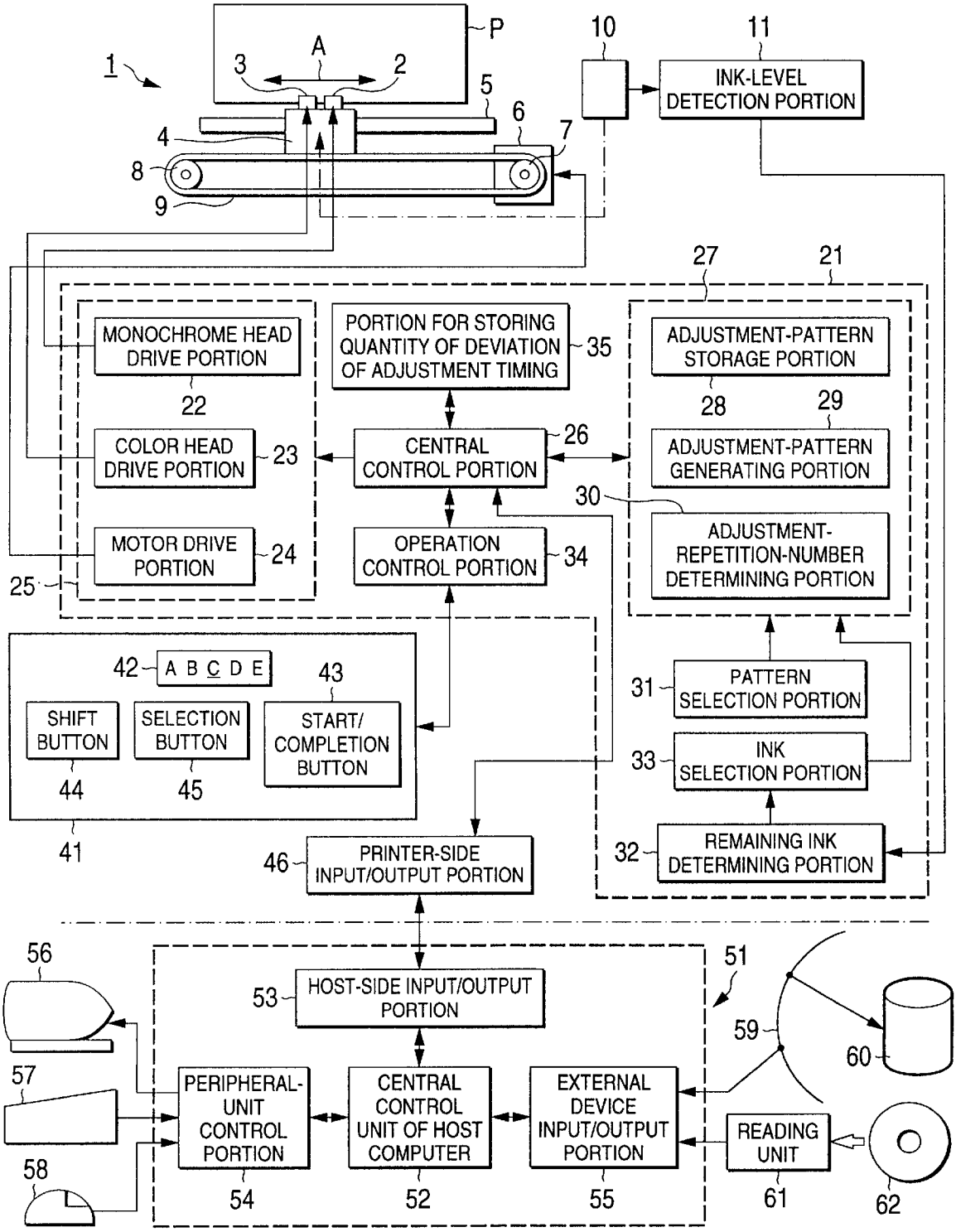
FIG. 1 is a schematic view showing a printing apparatus according to the present invention and a structure in which a control program for performing the function for adjusting the printing position is installed from a recording medium on a printing apparatus.

Embodiments of the present invention will now be described. FIG. 1 is a diagram showing the structure of a printing apparatus according to the present invention and a structure for installing a control program for executing the printing-position adjustment function from a recording medium on the printing apparatus.

Referring to FIG. 1, a drive mechanism 1 for the printing apparatus is provided. The drive mechanism 1 generally includes a carriage 4, a guide shaft 5, a carriage-drive motor 6, a drive pulley 7, a follower pulley 8, and a timing belt 9. A monochrome printing head 2 and a color printing head 3 are secured to the carriage 4. The carriage 4 is joined in such a manner that the carriage 4 is, by the horizontally disposed guide shaft 5, able to reciprocate in the direction of the lines which must be printed. The timing belt 9 is arranged between the drive pulley 7 joined to a drive shaft of the carriage-drive motor 6 and the follower pulley 8 disposed opposite to the drive pulley 7 in the axial direction of the guide shaft 5. Thus, the carriage 4 is, by the timing belt 9, able to reciprocate on the guide shaft 5 in the direction of the lines which must be printed, that is, the main scanning direction. The main scanning direction is indicated with an arrow A shown in FIG. 1.

The monochrome printing head 2 and the color printing head 3 disposed in parallel on the carriage 4 print dots on printing paper P placed on a platen (not shown). That is, the monochrome printing head 2 and the color printing head 3 are structured in such a manner as to print data while moving in the direction in which the two heads 2 and 3 are disposed.

The structure is arranged in such a manner that the monochrome printing head 2 and the color printing head 3 are supplied with black ink and color ink from an ink cartridge 10. Moreover, an ink-level-detecting portion 11 for detecting a remaining quantity of ink accommodated in the ink cartridge 10 is provided for the printing apparatus according to this embodiment.

The ink cartridge 10 has a cartridge in which black ink is enclosed and a cartridge in which color ink is enclosed which are disposed individually. Moreover, the ink-level detecting portion 11 is individually provided for each of the ink cartridges. The ink-level-detecting portion 11 corresponding to the cartridge in which color ink is enclosed is able to independently detect a remaining quantity of ink in each ink pack (for example, yellow, cyan and magenta).

A portion 21 surrounded by a dashed line is a printer control unit for controlling the drive mechanism 1 and the like. The printer control unit 21 includes a printing control unit 25 serving as a printing control means having a monochrome head drive portion 22, a color head drive portion 23 and a motor drive portion 24 which are surrounded by a dashed line. The monochrome head drive portion 22 is supplied with an instruction issued from a central control unit 26 comprising a microprocessor so as to supply a print command signal to the monochrome printing head 2. The color head drive portion 23 receives an instruction issued from the central control unit 26 so as to supply a print command signal to the color printing head 3. The motor drive portion 24 receives an instruction issued from the central control unit 26 so as to supply a drive signal to the carriage-drive motor 6.

An adjustment-pattern control unit 27 surrounded by a dashed line and serving as an adjustment-pattern control means is disposed in such a manner as to be capable of communicating data to and from the central control unit 26. The adjustment-pattern control unit 27 includes an adjustment-pattern storage portion 28, an adjustment-pattern generating portion 29 and an adjustment-repetition-number determination portion 30.

In the adjustment-pattern storage portion 28, various delay pattern data items for realizing the printing-position adjustment mechanism are stored. The adjustment-pattern generating portion 29 makes an access to the adjustment-pattern storage portion 28 so as to generate various adjustment patterns in which the relative quantities of deviation of printing timings to be described are changed in a stepped manner in accordance with data of the delay patterns. The adjustment-repetition-number determination portion 30 administrates the number of repetitions of sequential input of patterns each having a small quantity of deviation among a plurality of patterns printed by the monochrome printing head 2 and the color printing head 3, the patterns having a small quantity of deviation being supplied from a pattern input means to be described later.

The adjustment-pattern control unit 27 is structured in such a manner as to receive a command signal from a pattern selection portion 31. That is, the pattern selection portion 31 includes an administration table (not shown) for administrating color to be printed (ink which must be used) by the color printing head 3. Thus, selection is permitted from, for example, a first selection mode in which color to be printed (ink which must be used) by the color printing head 3 can be selected; a second selection mode in which color to be printed (ink which must be used) by the color printing head 3 is changed whenever the printing-position adjustment mode is started; a third selection mode in which color to be printed by the color head is changed whenever the plural patterns are printed after the printing-position adjustment mode has been started; and a fourth selection mode in which color to be printed by the color head is automatically selected in accordance with information of an ink level communicated from the ink-level-detecting portion as described later.

Moreover, information of the ink level is communicated from the ink-level-detecting portion 11 to the ink-level-determination portion 32. The ink-level-determination portion 32 monitors the level of ink, in particular, color ink (for example, the levels of yellow, cyan and magenta). If the fourth selection mode is selected by the pattern selection portion 31, the ink-level-determination portion 32 issues a command to the ink selection portion 33 so that control is performed in such a manner that ink remaining in a large quantity among color ink is used.

The central control unit 26 is arranged to communicate data to and from an operation control unit 34. The operation control unit 34 is structured in such a manner as to be capable of communicating data relating to operation and input to and from an operation panel 41 serving as a pattern input means. That is, the operation panel 41 incorporates a display unit 42 comprising, for example, an LCD, a start/completion button 43 for instructing to start/complete the printing-position adjustment operation, a cursor shift button 44 for shifting a cursor to any one of symbols (A, B, C, D and E) corresponding to patterns having small quantities of deviation and displayed on the display unit 42 in a printing-position adjustment mode to be described later and a selection button 45 for selecting the symbol corresponding to the position of the cursor.

The central control unit 26 is structured in such a manner as to be capable of communicating data to and from an adjustment-timing-deviation-quantity storage portion 35 forming an adjustment-timing-deviation-quantity storage means and comprising a nonvolatile memory. In the adjustment-timing-deviation-quantity storage portion 35, data of the quantity of deviation of the printing timing in accordance with the pattern having a small quantity of deviation supplied from the operation panel 41 is stored. In synchronization with data of the quantity of deviation of the printing timing stored in the adjustment-timing-deviation-quantity storage portion 35, the printing timings of the monochrome printing head 2 and the color printing head 3 are adjusted when a usual printing operation is performed.

On the other hand, a printer-side input/output portion 46 is connected to the central control unit 26 so that communication of data to and from a host computer, to be described later, is permitted.

A lower half portion of FIG. 1 sectioned by an alternate long and short dash line shows the structure of the host computer 51. The host computer 51 includes a host-side central processing unit 52 comprising a microprocessor. The host-side central processing unit 52 is structured in such a manner as to be capable of communicating data to and from the central control unit 26 through a printer-side input/output portion 46 of the printer. A peripheral-unit-control portion 54 is connected to the host-side central processing unit 52. A known display unit 56, a keyboard 57 and a mouse 58 are connected to the peripheral-unit-control portion 54.

On the other hand, an external-unit input/output portion 55 is connected to the host-side central processing unit 52. The host computer 51 is connected to a communication network 59 through the external-unit input/output portion 55. Moreover, communication of data to and from a server 60 on the network is permitted. Moreover, a reading unit 61 of a CD-ROM 62 is connected to the external-unit input/output portion 55.

In the CD-ROM 62, a control program for causing the printing apparatus to perform the printing-position adjustment method is stored. The control program read by the reading unit 61 is loaded into a RAM or the like (not shown) of the central control unit 26 of the printer through the host computer 51. Thus, a printing-position adjustment operation to be described later is performed. Note that the control program for performing the printing-position adjustment may be stored in the server 60 on the network. In this case, a method is employed in which the control program is purchased from, for example, a provider providing such a control program for download over the Internet.

The operation of the printing apparatus having the above-mentioned structure will now be described together with the printing-position adjustment method to be described below. When the printing position is adjusted, the control program for performing the adjustment of the printing position is, by the reading unit 61, read from the CD-ROM 62 in which the control is stored. Then, the control program is loaded into the control unit 21 of the printer control unit 21 through the host computer 51 so that an environment for performing the adjustment of the printing position is established.

If the control program for performing the adjustment of the printing position is stored in the server 60 on the Internet, the control program is purchased through the provider so that installation of the control program on the host computer 51 is permitted.

When the start/completion button 43 provided for the operation panel 41 and arranged to start the operation for adjusting the printing position is operated (i.e., when the start of an adjustment mode is detected), the adjustment is performed when the printer is delivered from the manufacturing plant or when the previous operation for adjusting the printing position has been performed. Thus, timing deviation data stored in the adjustment-timing-deviation-quantity storage portion 35 is read and supplied to the central control unit 26. When the central control unit 26 has received timing deviation data, the central control unit 26 makes an access to the adjustment-pattern control unit 27. Thus, the adjustment-pattern generating portion 29 generates data of first adjustment pattern in accordance with timing deviation data supplied from the adjustment-timing-deviation-quantity storage portion 35 and serving as a reference value.

When data of the first adjustment pattern has been generated, the central control unit 26 supplies data of the adjustment pattern to the printing control unit 25. While the carriage is moved in response to a motor drive signal supplied from the motor drive portion 24, a plurality of patterns are printed in response to print signals supplied from the monochrome head drive portion 22 and the color head drive portion 23.

If the first selection mode is attempted to be selected by the pattern selection portion 31, color ink selected manually is used to print the plural patterns. If the second selection mode is selected, different color ink is sequentially and cyclically used whenever the printing-position adjustment mode is started so that the plural patterns are printed. When the third selection mode has been selected, different color ink is sequentially and cyclically used to that the plural patterns are printed whenever the number of the operation for printing the pattern is increased from the first time and the second time. If the fourth selection mode is selected, color ink remaining in a largest quantity among the plural color ink is employed to print the plural patterns.

If the color printing head is able to print six color images which are yellow, cyan, magenta, purple (mixed color of cyan and magenta), green (mixed color of cyan and yellow) and orange (mixed color of magenta and yellow), the program may be formed in such a manner that yellow is not used because visibility of yellow is unsatisfactory.

First Embodiment of Printing-Position Adjustment Method

Figure 2:
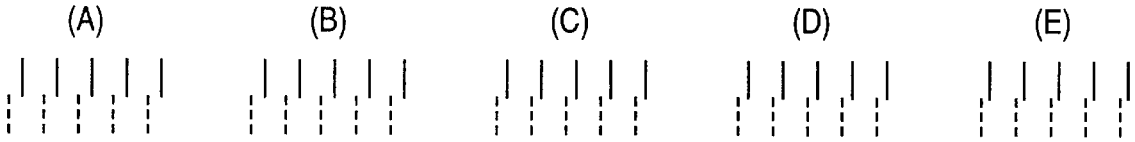
FIG. 2 is a diagram showing patterns printed by a printing-position adjustment method according to a first embodiment of the present invention.
Figure 2:
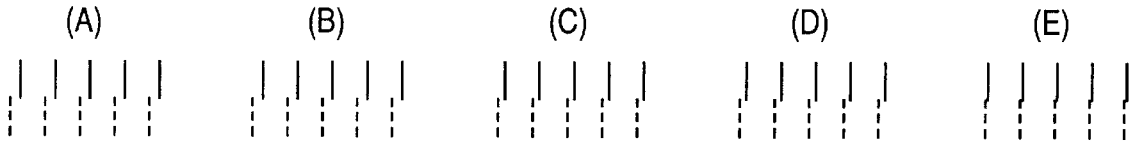
Figure 2:
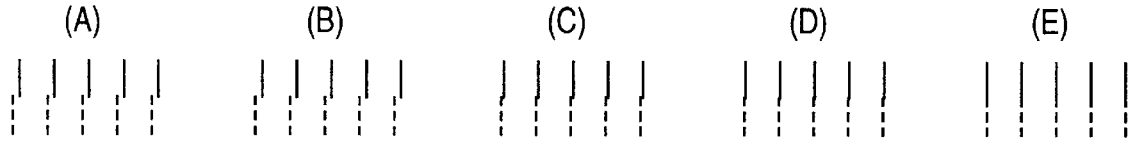
Figure 2:
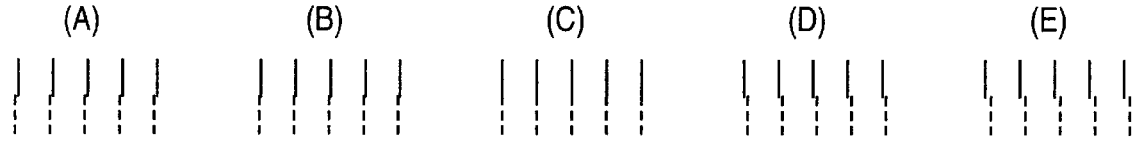

FIGS. 2(I) to 2(IV) show a first embodiment of the printing-position adjustment method according to the present invention. The printing-position adjustment method is arranged in such a manner that a plurality (five patterns (A) to (E)) of patterns, in which the relative quantity of deviation of the printing timings of the monochrome printing head 2 and the color printing head 3 is changed in a stepped manner, are simultaneously (in one operation) printed, as shown in FIG. 2(I).

In the illustrated patterns, solid lines indicate results of printing performed by the monochrome printing head and dashed lines indicate results of printing performed by the color printing head. The method of forming the above-mentioned patterns by an ink jet printer will now be described. The above-mentioned patterns can be formed by using upper half nozzles of a plurality of nozzles disposed on the ink discharge surface of the monochrome head in a direction perpendicular to a direction (main scanning direction A) in which the head is moved. The lower half nozzles are used by the color head.

As can be understood from printed patterns (A) to (E) shown in FIG. 2(I), the printing positions (indicated with dashed lines) of the color head with respect to the printing positions (indicated with solid lines) of the monochrome head are deviated to the right in a stepped manner in a direction from the pattern (A) to the pattern (E). In other words, the printer prints a set of stepped-deviation patterns, each having a different respective print deviation timing value that varies from the others by a certain step size, into the print deviation timing value represents a relative deviation of the printing timings of the two printing heads. Therefore, a user subjects the patterns (A) to (E) to comparisons to select a pattern having a smallest quantity of deviation, and then inputs a symbols (any one of A to E) corresponding to the selected pattern by using the operation panel 41. To put another way, the user causes an indication that corresponds to one of the set of just-printed patterns. Since the pattern (E) has the smallest quantity of deviation in this case, the symbol (E) is supplied.

The symbols A to E are displayed on the display unit 42 of the operation panel 41. When the cursor shift button 44 is sequentially depressed, the cursor is cyclically moved to the lower position of each of symbols A to E. When the selection button 45 is depressed in a state in which the cursor is moved to the symbol (E), a first pattern selection operation is completed.

When the above-mentioned input operation is performed with the operation panel 41, the adjustment-repetition-number determination portion 30 increases the administrated number by "1". Then, a second operation for printing the pattern is performed. That is, as shown in FIG. 2(II), the pattern corresponding to the supplied symbol, that is, the selected pattern (the pattern (E) shown in FIG. 2(I)) is used as a central value (the pattern (C) shown in FIG. 2(II)). This central value, in particular, becomes the basis for the printing of patterns in a subsequent pattern printing operation. Then, the adjustment-pattern generating portion 29 makes an access to the adjustment-pattern control unit 27 so as to generate the patterns (A) to (E), in which the relative quantity of deviation of the printing timings of the two heads is changed in a stepped manner. That is to say, the lowest respective print deviation timing value (i.e., pattern A) into the highest respective print deviation timing value (i.e., pattern E) are set on the basis the central value (i.e., the print deviation timing value of the pattern that was selected by the user in the previous pattern printing operation).

When the second adjustment pattern has been generated as described above, the central control unit 26 supplies data to be printed to the printing control unit 25 similar to the first operation. Thus, second printing of the patterns is performed by the two heads 2 and 3.

Then, the user subjects the printed patterns (A) to (E) to comparisons as shown in FIG. 2(II) to select a pattern having the smallest quantity of deviation. Then, the user inputs a symbol corresponding to the selected pattern by using the operation panel 41. Since the quantity of deviation of the pattern (E) is smallest in this case, the symbol (E) is input.

When the symbol (E) has been input by using the operation panel 41, the pattern corresponding to the supplied symbol, that is, the selected pattern (the pattern (E) shown in FIG. 2(II)) is used as a central value (the pattern (C) shown in FIG. 2(III)), as shown in FIG. 2(III). Then, the adjustment-pattern generating portion 29 generates the patterns (A) to (E), in which the relative quantity of deviation of the printing timings of the two heads is changed in a stepped manner. When the third adjustment pattern has been generated, the central control unit 26 supplies data to be printed to the printing control unit 25, similarly to the previous operation. Thus, the two heads 2 and 3 prints third patterns.

Then, the user subjects the printed patterns (A) to (E) to comparisons as shown in FIG. 2(III) to select a pattern having the smallest quantity of deviation. Then, the user inputs a symbol corresponding to the selected pattern by using the operation panel 41 similarly to the previous operation. Since the quantity of deviation of the pattern (E) is smallest in this case, the symbol (E) is input.

When the symbol (E) has been input by using the operation panel 41, the pattern corresponding to the supplied symbol, that is, the selected pattern (the pattern (E) shown in FIG. 2(III)) is used as a central value (the pattern (C) shown in FIG. 2(IV)), as shown in FIG. 2(IV). Then, the adjustment-pattern generating portion 29 generates the patterns (A) to (E), in which the relative quantity of deviation of the printing timings of the two heads is changed in a stepped manner. When the fourth adjustment pattern has been generated, the central control unit 26 supplies data to be printed to the printing control unit 25, similarly to the previous operation. Thus, the two heads 2 and 3 print a fourth set of patterns.

Then, the user subjects the printed patterns (A) to (E) to comparisons as shown in FIG. 2(IV) to select a pattern having the smallest quantity of deviation. Then, the user inputs a symbol corresponding to the selected pattern by using the operation panel 41 similarly to the previous operation. Since the quantity of deviation of the pattern (C) is smallest in this case, the symbol (C) is input. Since the selected pattern (C) is in a state in which substantially no deviation exists, the user operates the start/completion button 43 of the operation panel 41. When the user operates this button, this may be said to be an end of adjustment indication to the printer.

As a result, data of quantity of deviation of the printing timings corresponding to the symbol (the symbol (C) shown in FIG. 2(IV)) corresponding to the selected pattern is written on the adjustment-timing-deviation-quantity storage portion 35. Thus, the operation for adjusting the printing position of the printer is completed.

In the following and usual printing operation, the printing timings of the monochrome printing head 2 and the color printing head 3 are adjusted in accordance with data of the quantity of deviation of the printing timings stored in the adjustment-timing-deviation-quantity storage portion 35.

This embodiment is characterized in that the color to be printed by the color printing head is changed whenever the above-mentioned adjustment mode is started when the second selection mode has been selected by the pattern selection portion 31.

When printing-position adjustment is performed after the adjustment mode has been started in an initial stage of use of the printer, cyan is used. When the printing position is again adjusted subsequent to that, magenta is used. Thus, color is sequentially changed as cyan, magenta, purple, green, orange and cyan. As described above, the second selection mode is arranged in such a manner that the color to be printed by the color printing head is changed whenever the adjustment mode is started.

When the third selection mode has been selected by the pattern selection portion 31, color which is used by the color printing head is changed whenever one printing operation is performed (for example, the patterns (A) to (F) have been printed) in the adjustment operation described with reference to FIGS. 2(I) to 2(IV). That is, the number of times of the printing operations administrated by the adjustment-repetition-number determination portion 30 is used to sequentially change the color which is discharged from the color printing head.

According to this embodiment having the structure that the color to be printed by the color printing head is changed whenever the adjustment is performed, the problem in that ink in a specific color is consumed in a larger quantity as compared with ink of the other colors can be prevented.

Although the structure has been described in which the adjustment of the printing position is completed by performing four times of printing of the patterns (see FIG. 2(IV)), a pattern substantially free from deviation sometimes appears at, for example, the second operation for printing the patterns (see FIG. 2(II)) if the quantity of deviation of the printing positions of the two heads is relatively small. In this case, the adjustment operation is completed when the second operation for printing the patterns has been completed. If the quantity of deviation of the printing positions of the two heads is relatively large, a pattern substantially free from deviation does not appear even after the fourth operation for printing the patterns (see FIG. 2(IV)) have been performed. In this case, the foregoing operation is repeated and the adjustment operation is completed after a fifth or following operation for printing the patterns has been performed.

If a specific color is used in the color printing operation as has been employed in the conventional method, the specific color ink is consumed in a larger quantity. The structure according to this embodiment is able to prevent the above-mentioned problem.

As described above, the printing-position adjustment method according to this embodiment is arranged in such a manner that the pattern selected by a user is used as a central value. Moreover, a plurality of patterns in which the relative quantity of deviation of the printing timings of the two heads is changed in a stepped manner are printed. A pattern having a smallest quantity of deviation is, by the user, selected from the plural patterns. The above-mentioned process is repeated as necessary. Thus, the printing/timings of the two heads can be adjusted.

That is, the printing-position adjustment method according to this embodiment is arranged in such a manner that the patterns which must be printed simultaneously are printed at least in two times of operations. Moreover, plural patterns which are simultaneously printed at a second and following operations are in the form in which the pattern selected in the previous operation is used as the central value. As can be understood from FIGS. 2(I) to 2(IV), the quantity of deviation of the plurality of the patterns which are printed simultaneously is sequentially reduced as the number of the printing operations increases. That is, the state of deviation is converged gradually. That is, the quantity of deviation in the pattern shown in FIG. 2(II) is smaller than that in the pattern shown in FIG. 2(I). The quantity of deviation in the pattern shown in FIG. 2(III) is smaller than that of the pattern shown in FIG. 2(II). The quantity of deviation in the pattern shown in FIG. 2(IV) is smaller than that in the pattern shown in FIG. 2(III).

Since the patterns to be printed simultaneously are printed in at least two times of operations, the number of patterns required to be subjected to comparisons by a user in one operation can be reduced to at least half of the number required for the conventional method. As a result, the selection operation which is performed by the user can be simplified and facilitated. That is, the user is required to subject five patterns in each operation in the above-mentioned embodiment.

Since the quantity of deviation of the plural patterns in the stepped manner and which are simultaneously printed is converged as the number of times increases, the adjustment operation can efficiently be performed. Therefore, the adjustment operation which is performed by the user can easily be completed. Moreover, the range of the quantity of deviation which can be adjusted can be enlarged and the adjustment accuracy can be improved.

Namely, the adjustment method according to this embodiment is arranged in such a manner that printing of a plurality of patterns and the selection operation which is performed by a user are simply repeated until the adjustment is completed (until a pattern substantially free from deviation appears). Therefore, even if the range of the quantity of deviation which can be adjusted is enlarged, the operation required for the user does not become excessively complicated.

Therefore, even if the number of patterns is increased because the adjustment accuracy is improved, the adjustment can be performed in such a manner that printing of the plural patterns and the selection operation which is performed by the user are repeated. Therefore, the operation required for the user does not become excessively complicated.

That is, the number of the patterns which must be subjected to comparisons by the user can be reduced when the user selects an optimum pattern. Therefore, the user is able to easily select an optimum pattern. Moreover, the time it takes to print one set of patterns, and the amount of paper used, can both be reduced. Since the adjustment can sometimes be completed after the operation for printing the patterns has been performed two times, the time required to complete the adjustment, the quantity of printing paper and consumption of ink can significantly be reduced as compared with the conventional method.

Second Embodiment of Printing-Position Adjustment Method

Figure 3:
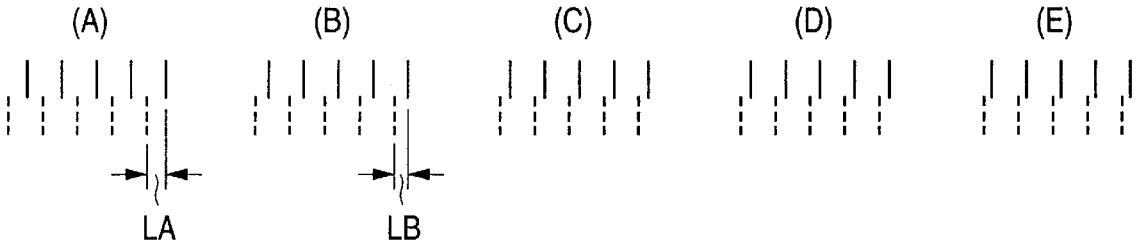
FIG. 3 is a diagram showing patterns printed by a printing-position adjustment method according to a second embodiment of the present invention.
Figure 3:
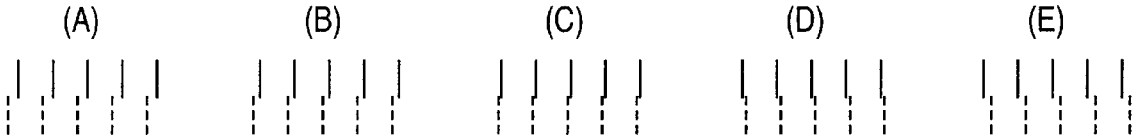
Figure 3:
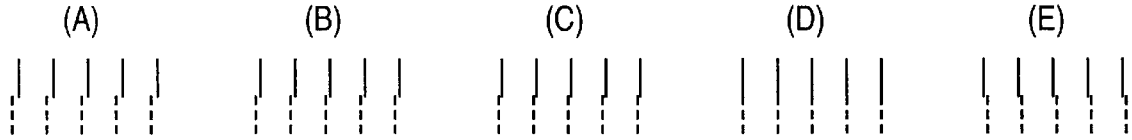
Figure 3:
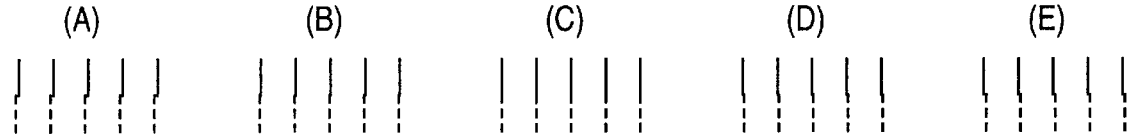

FIGS. 3(I) to 3(IV) are diagrams showing a second embodiment of the printing position adjustment method according to the present invention, in which states of printed patterns similarly to the above-mentioned embodiment are shown.

This embodiment is characterized in that the relative quantity of deviation which is changed among the plurality of the patterns to be printed is reduced as compared with the relative quantity of deviation changed in the pattern printed in the previous printing operation. This embodiment has a structure such that when a pattern except for an end pattern of the plural patterns is selected by a user, the relative quantity of deviation is reduced (i.e., the step size is made smaller in the next pattern printing operation than it was in the previous pattern printing operation). The other structures are similar to those of the first embodiment.

The structure according to this embodiment is arranged in such a manner that the adjustment-repetition-number determination portion 30 shown in FIG. 1 determines the number of repetitions used in sequentially adjusting the relative quantity of deviation. Moreover, the central control unit 26 determines a fact that a pattern of a plurality of patterns except for an end pattern has been selected by a user in accordance with a state of operation of the operation panel 41. It will be appreciated that the end patterns shown in the drawings are the ones that have the lowest respective print deviation timing value and the highest respective print deviation timing value of all of the patterns printed in the set. As was the case in the first embodiment, this range is based on the central value determined by the user selecting one of the printed patterns in the previous or prior pattern printing operation.

The printing-position adjustment method according to the second embodiment will now be described, and since the operation is in many ways similar to that of the printing-position adjustment method according to the first embodiment, it will be appreciated that the apparatus shown in FIG. 1 can be used. In describing this second embodiment according to the invention, it may be assumed that the function of the blocks shown in FIG. 1 is the same as in the first embodiment, except where noted. With FIG. 1 in mind, a description of the adjustment method will be given with attention being directed to the printing pattern shown in FIG. 3.

The printing-position adjustment method according to the second embodiment will now be described. Initially, a plurality (which is five from (A) to (E)) of patterns, in which the relative quantity of deviation of the monochrome head and the color head is changed in a stepped manner, are simultaneously printed, as shown in FIG. 3(I).

In this case, the relative quantity of deviation (the pitch to be changed) in a stepped manner is determined to be, for example, 0.6 mm. Therefore, the distance from the printing position (indicated with solid lines) of the monochrome head to the printing position (indicated with dashed lines) of the color head is, as shown in FIG. 3(1), made in such a manner that distance LB in the pattern (B) is shorter than distance IA in the pattern (A) by 0.6 mm.

Similarly, the distance in the pattern (C) is shorter than that in the pattern (B) by 0.6 mm, the distance in the pattern (D) is shorter than that in the pattern (C) by 0.6 mm, and the distance in the pattern (E) is shorter than that in the pattern (D) by 0.6 mm.

That is, the printing position (indicated with dashed lines) of the color head with respect to the printing position (indicated with solid lines) of the monochrome head is deviated to the right at pitches of 0.6 mm in a direction from the pattern (A) to the pattern (E).

Therefore, a user subjects the patterns (A) to (E) to comparison to select a pattern having a smallest quantity of deviation, and then inputs a symbol corresponding to the selected pattern to the operation panel. Since the pattern (E) has a smallest quantity of deviation in this case, symbol (E) is input by using the operation panel.

When the symbol (E) has been input by using the operation panel, the pattern corresponding to the supplied symbol, that is, the selected pattern (the pattern (E) shown in FIG. 2(I)) is used as a central value (the pattern (C) shown in FIG. 3(II)), as shown in FIG. 3(II). Then, the patterns (A) to (E), in which the relative quantity of deviation of the printing timings of the two heads is changed in a stepped manner, are simultaneously printed. Also in this case, the relative quantity of deviation (the pitch which must be changed) in a stepped manner is determined to be 0.6 mm.

Therefore, the printing position (indicated with the dashed lines) of the color head with respect to the printing position (indicated with the solid lines) of the monochrome head is deviated to the right at pitches of 0.6 mm in a direction from the pattern (A) to the pattern (E).

Then, the user subjects the printed patterns (A) to (E) to comparisons as shown in FIG. 3(II) to select a pattern having the smallest quantity of deviation. Then, the user inputs a symbol corresponding to the selected pattern by using the operation panel. Since the quantity of deviation in the pattern (C) and that in the pattern (D) are substantially the same and the quantity is smaller than quantity of deviation in the other patterns (A), (B) and (E) in this case, the symbol (C) or (D) is input by using the operation panel. In this embodiment, an assumption is made that the symbol (C) has been input by using the operation panel.

When the symbol (C) has been input, the pattern corresponding to the supplied symbol, that is, the selected pattern (the pattern (C) shown in FIG. 2(II)) is used as a central value (the pattern (C) shown in FIG. 3(III)), as shown in FIG. 3(III). In this state, the patterns (A) to (E) in which the relative quantity of deviation of the printing timings of the two heads is changed in a stepped manner are simultaneously printed.

Since the pattern (C) of the plurality of the patterns (A) to (E) shown in FIG. 3(II) except for the end patterns (A) and (E) has been selected by the user in this case, the relative quantity of deviation is reduced to, for example, 03 mm. Therefore, the printing position (indicated with dashed lines) of the color head with respect to the printing position (indicated with solid lines) of the monochrome head is, in the case shown in FIG. 3(III), deviated to the right at pitches of 03 mm in a direction from the pattern (A) to the pattern (E).

Therefore, the user subjects the printed patterns (A) to (E) to comparisons as shown in FIG. 3(III) to select a pattern having the smallest quantity of deviation. Then, the user inputs a symbol corresponding to the selected pattern by using the operation panel. Since the quantity of deviation in the pattern (D) is smallest, the symbol (D) is input by using the operation panel.

When the symbol (D) has been input, the pattern corresponding to the supplied symbol, that is, the selected pattern (the pattern (D) shown in FIG. 3(III)) is used as a central value (the pattern (C) shown in FIG. 3(IV)), as shown in FIG. 3(IV). In this state, the patterns (A) to (E) in which the relative quantity of deviation of the printing timings of the two heads is changed in a stepped manner are simultaneously printed.

Since the pattern (D) of the plurality of the patterns (A) to (E) shown in FIG. 3(III) except for the end patterns (A) and (E) has been selected by the user in this case, the relative quantity of deviation is reduced to, for example, 0.15 mm.

Therefore, the printing position (indicated with dashed lines) of the color head with respect to the printing position (indicated with solid lines) of the monochrome head is, in the case shown in FIG. 3(IV), deviated to the right at pitches of 0.15 mm in a direction from the pattern (A) to the pattern (E).

Therefore, the user subjects the printed patterns (A) to (E) to comparisons as shown in FIG. 3(IV) to select a pattern having the smallest quantity of deviation. Then, the user inputs a symbol corresponding to the selected pattern by using the operation panel. Since the quantity of deviation in the pattern (C) is smallest, the symbol (C) is input.

Since the selected pattern (C) is substantially free from deviation, the user operates the start/completion button 43 similarly to the foregoing process and thus the adjustment operation is completed.

Then, data of the quantity of deviation of the printing timing corresponding to the finally selected symbol (which is (C) shown in FIG. 3(IV)), is written on the adjustment-timing-deviation-quantity storage portion 35. Thus, the operation for adjusting the printing position of the printer is completed.

Then, the following and usual printing operation is performed in such a manner that the printing timings of the monochrome printing head 2 and the color printing head 3 are adjusted in accordance with data of the deviation of the printing timings stored in the adjustment-timing-deviation-quantity storage portion 35, similarly to the above-mentioned process.

Although the adjustment can be completed in the above-mentioned example after only the fourth pattern-printing operation (i.e., the pattern printing operation depicted in FIG. 3-IV), further repetitions of the adjustment operation can be performed with an even further reduced step size (for example, to 0.075 mm or furthermore reduced to 0.04 mm). In this manner, an even more precise adjustment of the printing position can be achieved.

Also according to the second embodiment, selection of the second selection mode by the pattern selection portion 31 enables the color to be printed by the color printing head to be changed whenever the foregoing adjustment mode is started.

When the third selection mode has been selected by the pattern selection portion 31, the color to be printed can be changed whenever one printing operation is performed (whenever, for example, the patterns (A) to (E) have been printed) in the adjustment operation described with reference to FIGS. 3(I) to 3(IV).

According to the above-mentioned embodiments, a problem in that only a specific color of ink is consumed as compared with ink in the other colors can be prevented.

Although the invention has been described in its preferred form, it is understood that the present disclosure of the preferred form can be changed in the details of construction and in the combination and arrangement of parts without departing from the spirit and the scope of the invention.

For example, (1) Although the foregoing embodiments have the structure that the number of patterns to be printed in one printing operation is determined to be five, the number can arbitrarily be determined. It is preferable that the number is about 3 to about 15, more preferably about 4 to about 7.

(2) The line segments which are printed as a result of one time of scanning operation are formed into dashed-line shapes because the intervals of nozzles of the color head according to the above-mentioned embodiments are relatively long. The shapes may be formed into solid lines when printing in one direction is repeated by feeding paper in a small quantity.

(3) When the above-mentioned adjustment method is performed, the priority of color ink is determined in accordance with information about the remaining quantity of in supplied from the ink-level-detecting portion. However, another structure may be employed in which color ink to be used is changed whenever the adjustment is performed (whenever the adjustment mode is started) or whenever one printing operation is performed in one adjustment operation (for example, whenever the patterns (A) to (E) are printed). Thus, the necessity of using information about the remaining quantity which is supplied from the ink-level-detecting portion can be eliminated. Thus, the structure can be simplified.

Figure 4:
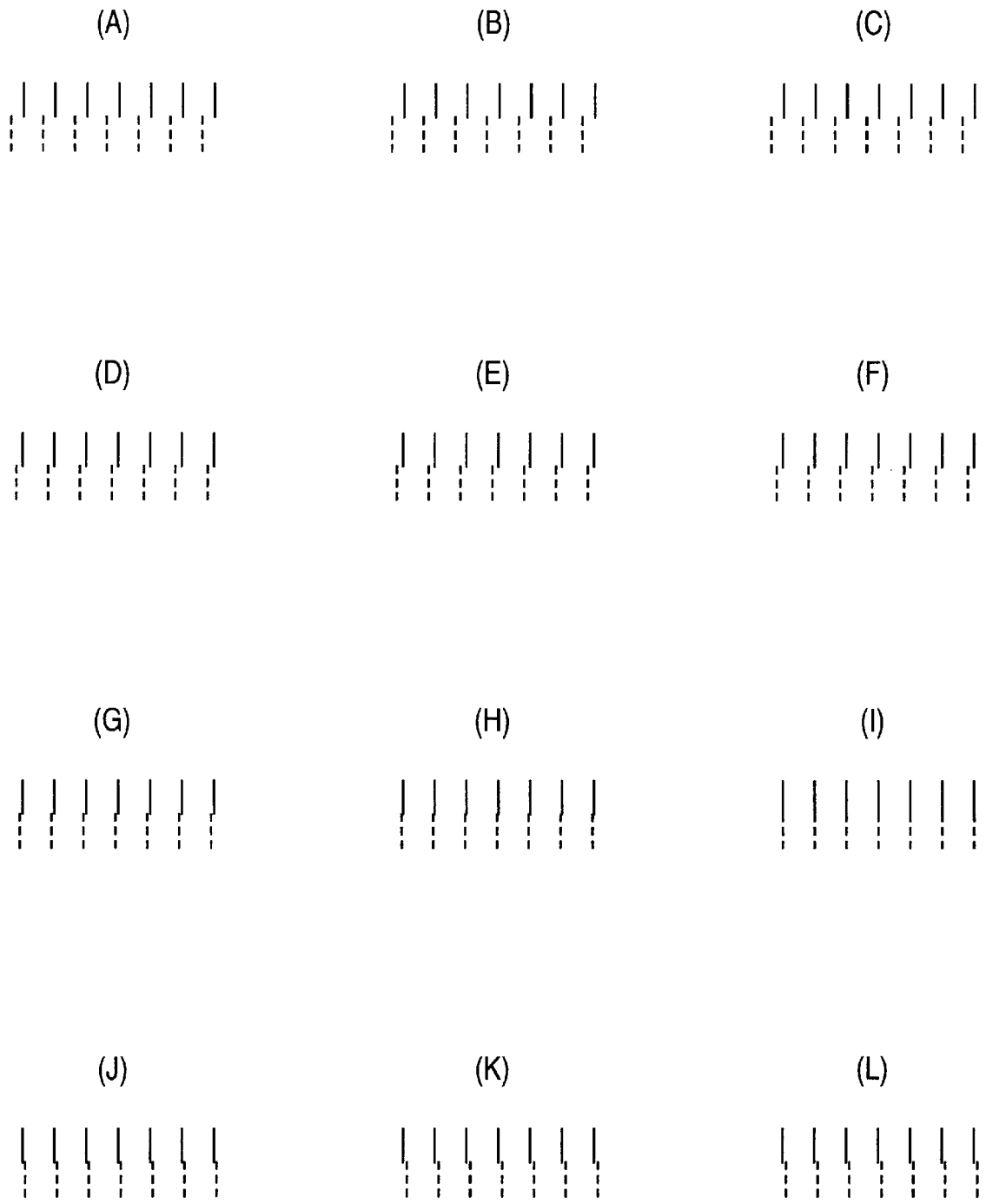
FIG. 4 is a diagram showing patterns printed by a conventional printing-position adjustment method.

(4) In the foregoing embodiments, the color to be printed by the color printing head is changed when the printing-position adjustment as shown in FIG. 2 or FIG. 3 is performed. However, the structure is not limited to this. The color to be printed by the color printing head may be changed with the printing-position adjustment method structured as shown in FIG. 4.

What is claimed is:

1. A printing-position adjustment method for a printing apparatus having a first printing head and a second printing head, the printing-position adjustment method comprising:

(a) printing stepped-deviation patterns, each with a different respective print deviation timing value varying from another of the stepped-deviation patterns by a step size, wherein the print deviation timing value represents a relative deviation of printing timings of the two printing heads, the stepped-deviation patterns defining a prior set of printed patterns; then (b) receiving a selection indicator corresponding to one of the prior set of printed patterns, and setting the respective print deviation timing value of the selected one of the prior set of printed patterns as a central value for a subsequent set of printed patterns;

(c) printing the subsequent set of stepped-deviation patterns with a lowest respective print deviation timing value and a highest respective print deviation timing value being based on the central value, the subsequent stepped-deviation patterns, after printing, defining the prior set of printed patterns;

(d) until an end of adjustment indication is received, repeating the steps (b) and (c).

2. The printing-position adjustment method according to claim 1, wherein the printing of the subsequent stepped-deviation patterns is performed with the respective step size smaller than the respective step size used in printing the prior set of printed patterns.

3. The printing-position adjustment method according to claim 2, wherein the smaller respective step size is used only when the selected one of the prior set of printed patterns does not have the highest respective print deviation timing value and does not have the lowest respective print deviation timing value for the prior set of printed patterns.

4. A printing-position adjustment method for a printing apparatus having a monochrome printing head and a color printing head, the color printing head being adapted to print a plurality of colors, the printing-position adjustment method comprising:

in response to detecting a start of an adjustment mode, printing patterns each with a different respective print deviation timing value, wherein the print deviation timing value represents a relative deviation of printing timings of the two printing heads, each of the patterns including a monochrome component printed by the monochrome printing head and a color component printed by the color printing head in a given one of the plurality of colors; and in response to detecting a subsequent start of the adjustment mode, performing a subsequent printing of the patterns with the color component being a different color from the given one of the plurality of colors.

5. A printing-position adjustment method for a printing apparatus having a monochrome printing head and a color printing head, the color printing head being adapted to print a plurality of colors, the printing-position adjustment method comprising:

in response to detecting a start of an adjustment mode, printing patterns each with a different respective print deviation timing value, wherein the print deviation timing value represents a relative deviation of printing timings of the two printing heads, each of the patterns including a monochrome component printed by the monochrome printing head and a color component printed by the color printing head in a given one of the plurality of colors; and performing, one or more times, a subsequent printing of the patterns;

wherein the color component for each of the one or more times of the subsequent printing is a different color from the preceding printing of the patterns.

6. A printing apparatus having a first printing head and a second printing head, comprising:

printing control means for printing stepped-deviation patterns, each with a different respective print deviation timing value varying from another of the stepped-deviation patterns by a step size, wherein the print deviation timing value represents a relative deviation of printing timings of the two printing heads, the stepped-deviation patterns defining a prior set of printed patterns;

pattern input means for receiving a selection indicator corresponding to one of the prior set of printed patterns;

adjustment-pattern control means for performing administration to repeat at least one time, until an end of adjustment indication is received, the steps of:

setting the respective print deviation timing value of the selected one of the prior set of printed patterns as a central value for a subsequent set of printed patterns, and issuing a command to the printing control means for printing the subsequent set of stepped-deviation patterns with a lowest respective print deviation timing value and a highest respective print deviation timing value being based on the central value, the subsequent stepped-deviation patterns, after printing, defining the prior set of printed patterns; and means for storing print deviation timing values in accordance with the selection indicator received by the pattern input means.

7. A printing apparatus according to claim 6, wherein the adjustment-pattern control means performs control in such a manner that the printing of the subsequent stepped-deviation patterns is performed with the respective step size smaller than the respective step size used in printing the prior set of printed patterns.

8. A printing apparatus according to claim 7, wherein the smaller respective step size is used only when the selected one of the prior set of printed patterns does not have the highest respective print deviation timing value and does not have the lowest respective print deviation timing value for the prior set of printed patterns.

9. A printing apparatus having a monochrome printing head and a color printing head, the color printing head being adapted to print a plurality of colors, the printing apparatus comprising:

printing control means for patterns each with a different respective print deviation timing value, wherein the print deviation timing value represents a relative deviation of printing timings of the two printing heads, each of the patterns including a monochrome component printed by the monochrome printing head and a color component printed by the color printing head in a given one of the plurality of colors;

pattern input means for receiving a selection indicator corresponding to one of the prior set of printed patterns;

means for storing print deviation timing values in accordance with the selection indicator received by the pattern input means; and adjustment-pattern control means for issuing a command for performing a subsequent printing of the patterns with the color component being a different color from the given one of the plurality of colors, in response to detecting a subsequent start of the adjustment mode.

10. A printing apparatus having a monochrome printing head and a color printing head, the color printing head being adapted to print a plurality of colors, the printing apparatus comprising:

printing control means for printing stepped-deviation patterns, each with a different respective print deviation timing value varying from another of the stepped-deviation patterns by a step size, wherein the print deviation timing value represents a relative deviation of printing timings of the two printing heads, the stepped-deviation patterns defining a prior set of printed patterns, each of the printed patterns including a monochrome component printed by the monochrome printing head and a color component printed by the color printing head in a given one of the plurality of colors; and pattern input means for receiving a selection indicator corresponding to one of the prior set of printed patterns;

adjustment-pattern control means for performing administration to repeat at least one time, until an end of adjustment indication is received, the steps of:

setting the respective print deviation timing value of the selected one of the prior set of printed patterns as a central value for a subsequent set of printed patterns, and issuing a command to the printing control means for printing the subsequent set of stepped-deviation patterns with a lowest respective print deviation timing value and a highest respective print deviation timing value being based on the central value, the subsequent stepped-deviation patterns having a different color for the color component from the prior set of printed patterns;

means for storing print deviation timing values in accordance with the selection indicator received by the pattern input means;

wherein, after printing, the subsequent set of stepped-deviation patterns is defined as the prior set of printed patterns.

11. A printing apparatus according to anyone of claims 6 to 10, further comprising a host computer receiving a control program for controlling the printing control means and the adjustment-pattern control means.

12. A printing apparatus according to claim 11, wherein the host computer receives the control program through a communication network.

13. A printing apparatus according to claim 11, wherein the host computer comprises a reading unit, and receives the control program from a recording medium read through the reading unit.

14. A computer program product for head alignment of a printing apparatus, comprising:

a computer readable medium, and computer instructions comprising a control program for controlling a printing apparatus to perform predetermined steps;

wherein the predetermined steps comprise:

printing stepped-deviation patterns, each with a different respective print deviation timing value varying from another of the stepped-deviation patterns by a step size, wherein the print deviation timing value represents a relative deviation of printing timings of the two printing heads, the stepped-deviation patterns defining a prior set of printed patterns; then receiving a selection indicator corresponding to one of the prior set of printed patterns, and setting the respective print deviation timing value of the selected one of the prior set of printed patterns as a central value for a subsequent set of printed patterns;

printing the subsequent set of stepped-deviation patterns with a lowest respective print deviation timing value and a highest respective print deviation timing value being based on the central value, the subsequent stopped-deviation patterns, after printing, defining the prior set of printed patterns;

until an end of adjustment indication is received, repeating the steps of receiving the selection indicator and printing the subsequent set of stepped-deviation patterns.

15. A computer program product according to claim 14, wherein the predetermined steps include the printing of the subsequent stepped-deviation patterns being performed with the respective step size smaller than the respective step size used in printing the prior set of printed patterns.

16. A computer program product according to claim 15, wherein the predetermined steps include the smaller respective step size being used only when the selected one of the prior set of printed patterns does not have the highest respective print deviation timing value and does not have the lowest respective print deviation timing value for the prior set of printed patterns.

17. A computer program product for head alignment of a printing apparatus, the printing apparatus having a monochrome printing head and a color printing head, the color printing head being adapted to print a plurality of colors, the computer program product comprising:

a computer readable medium, and computer instructions comprising a control program for controlling a printing apparatus to perform predetermined steps;

wherein the predetermined steps comprise:

in response to detecting a start of an adjustment mode, printing patterns each with a different respective print deviation timing value, wherein the print deviation timing value represents a relative deviation of printing timings of the two printing heads, each of the patterns including a monochrome component printed by the monochrome printing head and a color component printed by the color printing head in a given one of the plurality of colors; and in response to detecting a subsequent start of the adjustment mode, performing a subsequent printing of the patterns with the color component being a different color from the given one of the plurality of colors.

18. A computer program product for head alignment of a printing apparatus, the printing apparatus having a monochrome printing head and a color printing head, the color printing head being adapted to print a plurality of colors, the computer program product comprising:

a computer readable medium, and computer instructions comprising a control program for controlling a printing apparatus to perform predetermined steps;

wherein the predetermined steps comprise:

in response to detecting a start of an adjustment mode, printing patterns each with a different respective print deviation timing value, wherein the print deviation timing value represents a relative deviation of printing timings of the two printing heads, each of the patterns including a monochrome component printed by the monochrome printing head and a color component printed by the color printing head in a given one of the plurality of colors; and performing, one or more times, a subsequent printing of the patterns;

wherein the color component for each of the one or more times of the subsequent printing is a different color from the preceding printing of the patterns.

19. A computer program product according to any one of claims 14 to 18, wherein the computer readable medium is a CD-ROM.

* * * * *